US006741039B2

(12) United States Patent
Lee et al.

(10) Patent No.: US 6,741,039 B2
(45) Date of Patent: May 25, 2004

(54) FED DRIVING METHOD

(75) Inventors: Chun-Tao Lee, Hsinchu (TW); Cheng-Chung Lee, Hsinchu (TW); Jyh-Rong Sheu, Hsinchu (TW); Yu-Yang Chang, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/145,723

(22) Filed: May 16, 2002

(65) Prior Publication Data

US 2003/0122118 A1 Jul. 3, 2003

(30) Foreign Application Priority Data

Dec. 27, 2001 (TW) ..... 90132447 A

(51) Int. Cl.[7] ..... G09G 3/10; H01J 1/62
(52) U.S. Cl. ..... 315/169.3; 313/310
(58) Field of Search ..... 315/169.3, 169.1, 315/169.4, 169.2; 345/60.741, 77, 84, 204; 313/310, 309, 495; G09G 3/10; H01J 1/62

(56) References Cited

U.S. PATENT DOCUMENTS 5,866,988 A * 2/1999 Oda ..... 315/169.1
5,945,777 A * 8/1999 Janning et al. ..... 313/310
6,414,444 B2 * 7/2002 Fox et al. ..... 315/169.3
6,445,122 B1 * 9/2002 Chuang et al. ..... 313/495
2002/0036599 A1 * 3/2002 Nishimura et al. ..... 345/11
2002/0041163 A1 * 4/2002 Ichikawa ..... 315/169.1
2002/0053869 A1 * 5/2002 Ahn et al. ..... 313/495
2002/0110996 A1 * 8/2002 Yaniv et al. ..... 438/469
2002/0135295 A1 * 9/2002 Wang et al. ..... 313/495

* cited by examiner

*Primary Examiner*—Don Wong
*Assistant Examiner*—Trinh Vo Dinh
(74) *Attorney, Agent, or Firm*—Birch, Stewart, Kolasch & Birch, LLP

(57) ABSTRACT

An improved FED driving method, which uses a voltage control different from the prior FED, to turn an electron beam on/off and increase the resolution. The improved FED driving method is characterized in increasing a positive voltage applied to the FED's anode, grounding the FED's emitter and applying a negative voltage to the FED's gate. When driving the FED, the anode can pull electron beam out of the cathode with high accelerate voltage and the applied negative voltage on the gate can turn the electron beam on/off. As such, this allows a higher resolution because the electron beam is not influenced by the gate's lateral attraction and high lighting efficiency with high anode accelerate voltage.

11 Claims, 7 Drawing Sheets

FED DRIVING METHOD

BACKGROUND OF THE INVENTION

1. Field of the Invention

The invention relates to an improved FED driving method, which uses a voltage control different from the prior FED, to turn an electron beam on/off, increase the resolution and lighting efficiency.

2. Description of Related Art

FIG. 1 is a diagram of a typical FED structure formed by thin film technique. In FIG. 1, the typical FED structure is a triode structure: a gate 5, an anode 9 and a cathode 10 including microtips 2 located in respective emitter cavities 3. As shown in FIG. 1, the triode structure is a structure capable of increasing electronic energy and lighting efficiency and reducing control voltage, wherein the anode 9 is applied to about 7 kV to increase electronic energy, the microtips 2 grounded in the cathode 10 emit the electron beams 4, and the gate 5 is applied to about 200V (or less) to pull out the electron beams 4 from microtips 2 of the cathode 10. Such a structure can have higher lighting efficiency due to the high anode voltage on anode 9 (for example, about 7 kV as mentioned above). However, it also has the disadvantages of high cost and low life duration on the microtips 2 so that does not fit for a large-sized panel display manufacture.

FIG. 2 is a diagram of another typical FED structure formed by nanotechnology. In FIG. 2, the structure is the same as that of FIG. 1 except that the microtips 2 are replaced by the low work function electronic emitters 6 (i.e., the needle-like arrangement in the respective emitter cavities 3). As shown in FIG. 2, such a structure has low work function such that the electronic emission requirement from the electronic emitters 6 is about 2–3 V/um, much less than the requirement from the micrptips 2 (about 70–80 V/um) The height of the spacer 8 connected between the anode 9 and the cathode 10 influences the required anode voltage for pulling the electrons out of the electronic emitter 6. In an example of the spacer 8 with about 1 mm height, the anode 9 in FIG. 1 with the microtips needs about 70–80 thousand volts to produce the electron beam. Generally, the anode voltage is not so high, only several kilo Volts, so need the gate to pull the electrons. While the anode 9 in FIG. 2 with the low work function electronic emitters needs only about 2–3 kV to produce the electron beam from the cathode, the gate losses the electron-pulled function and cannot turn the electron beam on/off. To recover the electron beam on/off control, the anode voltage is reduced. However, this causes lower lighting efficiency. Further, if the height from the electronic emitter 6 to the anode 9 is increased, the anode voltage can increase up to the lighting efficiency as in FIG. 1 under the same driving conditions and the gate can turn the electron beam on/off at the same time. However, the increased height makes a larger scattering area due to the gate's lateral attraction, when the electron beam hits the anode plate, so as to reduce the resolution.

A summary of adjusting a typical FED structure driving method by the factors of resolution and lighting efficiency is shown in the following relationship.

1. A method of increasing lighting efficiency is: increasing the anode voltage and the spacer height between the anode and the cathode. However, this causes the electron beam's divergence by the gate's lateral attraction and reduces the resolution. The spacer is higher, the resolution lower.

2. A method of increasing resolution is: fixed spacer height with an increased anode voltage to enhance the verticality of the electron beam emitted and reduce the gate voltage in order to decrease the beam's divergence. However, this will loss the gate's control over to the electron beam.

As cited above, the typical FED triode structure's driving method cannot have high lighting efficiency and high resolution when using a low work function electronic emitter.

SUMMARY OF THE INVENTION

Accordingly, an object of the invention is to provide an improved FED with low work function electronic emitters driving method, which uses a voltage control different from the prior triode FED, to turn an electron beam on/off and increase the resolution.

The invention provides an improved FED driving method, which uses a voltage control method by a combination of diode driving and gate control, so as to increase resolution and maintain electron beam on/off control. The improved FED driving method is characterized in increasing a positive voltage applied to the FED's anode, grounding the FED's emitter and applying a negative voltage to the FED's gate. When driving the FED, the anode can pull the electron beam out of the cathode and the applied negative voltage on the gate can turn the electron beam on/off. As such, this allows a higher resolution because the electron beam is not influenced by the gate's lateral attraction and high lighting efficiency with high anode voltage.

DETAILED DESCRIPTION OF THE INVENTION

The following numbers denote the same elements throughout the description and drawings.

Figure 1:
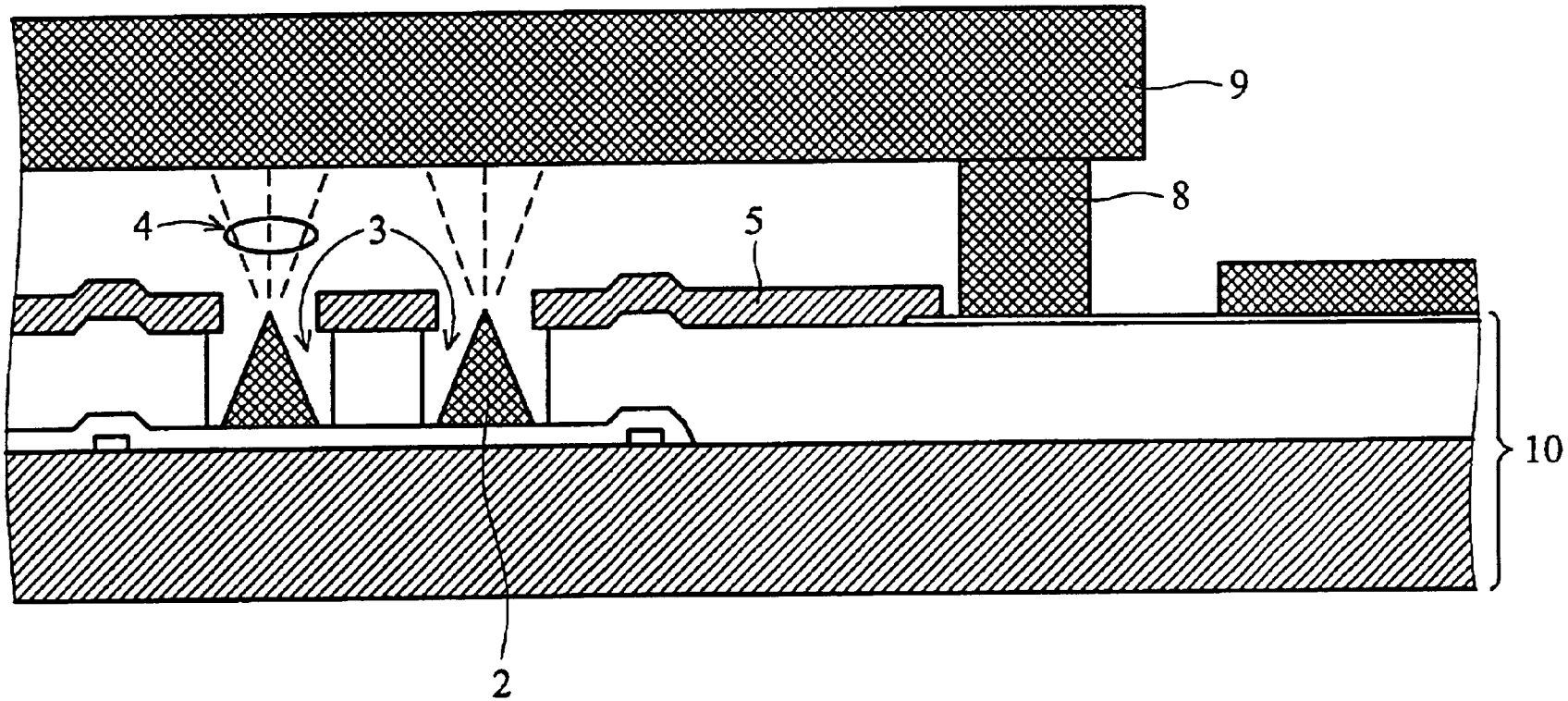
FIG. 1 (PRIOR ART)
FIG. 1 is a diagram of a typical FED structure formed by the thin film technique.
Figure 2:
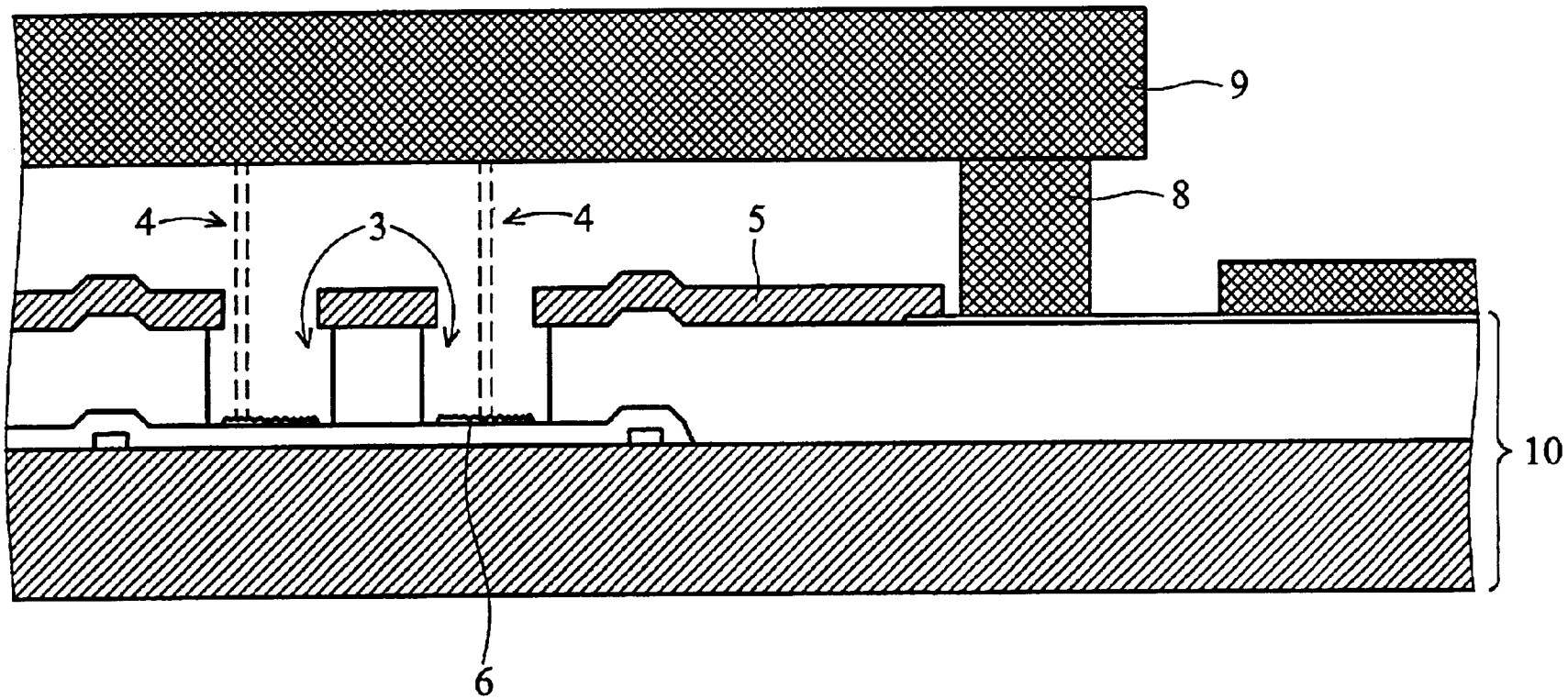
FIG. 2 (PRIOR ART)
FIG. 2 is a diagram of another typical FED structure formed by nanotechnology.
Figure 3:
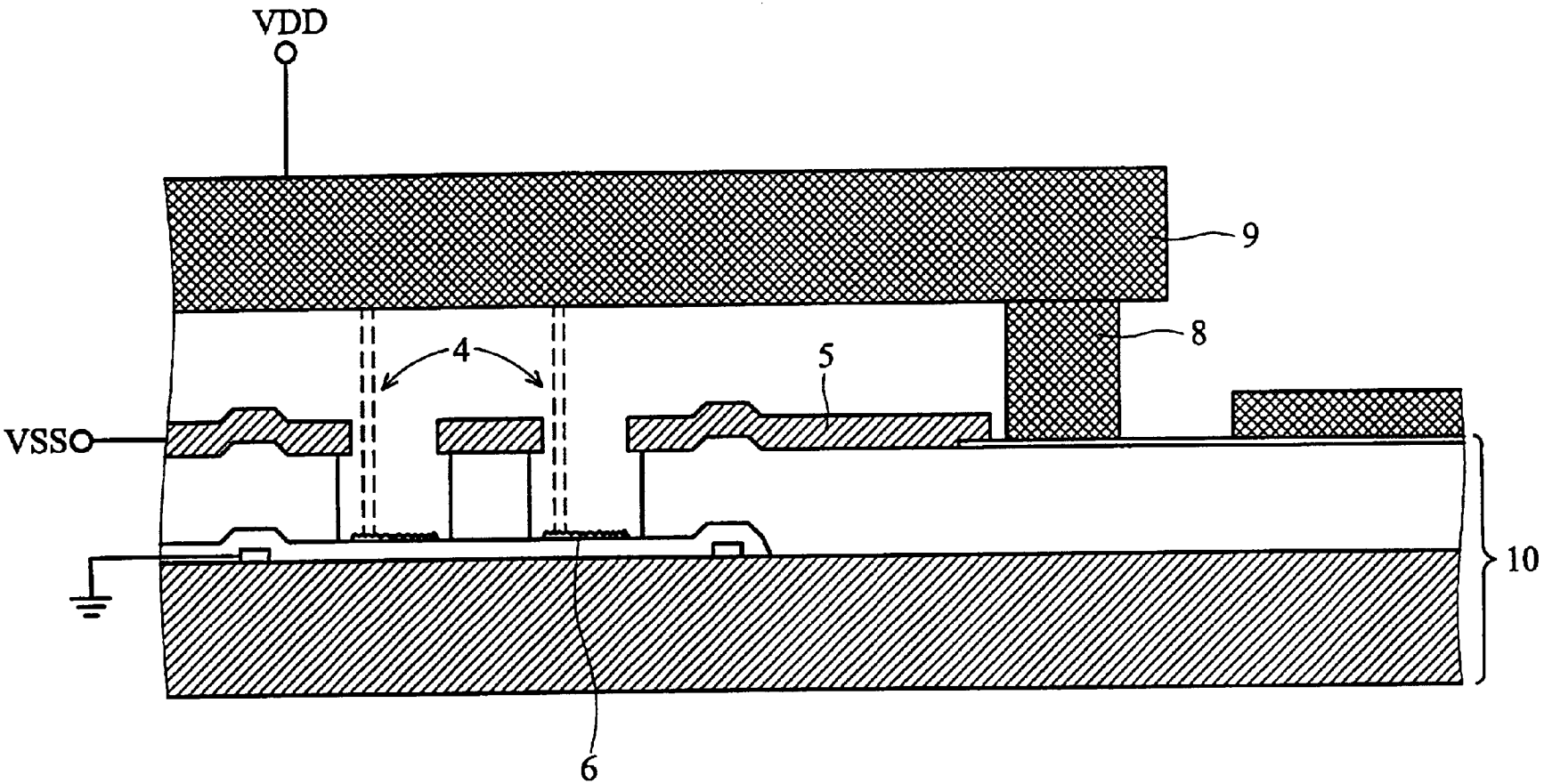
FIG. 3 is a schematic diagram of the FED structure of FIG. 2 with the driving method according to the invention.

FIG. 3 is a schematic diagram of the FED structure of FIG. 2 with the driving method according to the invention. As shown in FIG. 3, in such a triode structure, an emitter 6 is grounded to make the turn on voltage zero. An anode 9 is applied in a positive anode voltage VDD, for example, about 7 kV, to generate the required high voltage for pulling electrons out of the emitter 6. A gate 5 is applied in a negative driving voltage VSS, for example, about −200V, to block the potential from the anode 9 to the cathode 10 and produce the ability to turn the electron beam on/off. When VSS=0, electrons are continuously emitted by the emitter 6 due to the positive anode voltage VDD. When VSS reaches a certain negative value, the electronic emission is turned off because the negative driving voltage inhibits electrons from being emitted. Because electrons are normally emitted, a triode FED structure with the inventive driving method is referred as a diode driving, gate controlling FED structure.

Figure 4B:
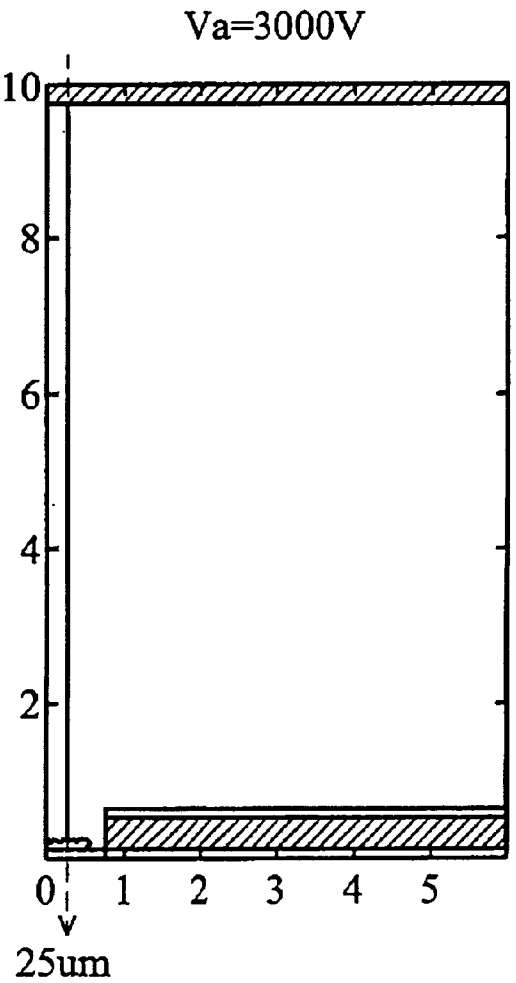
FIG. 4*b* is a diagram of an electron beam emitted by the driving method of FIG. 3.
Figure 4A:
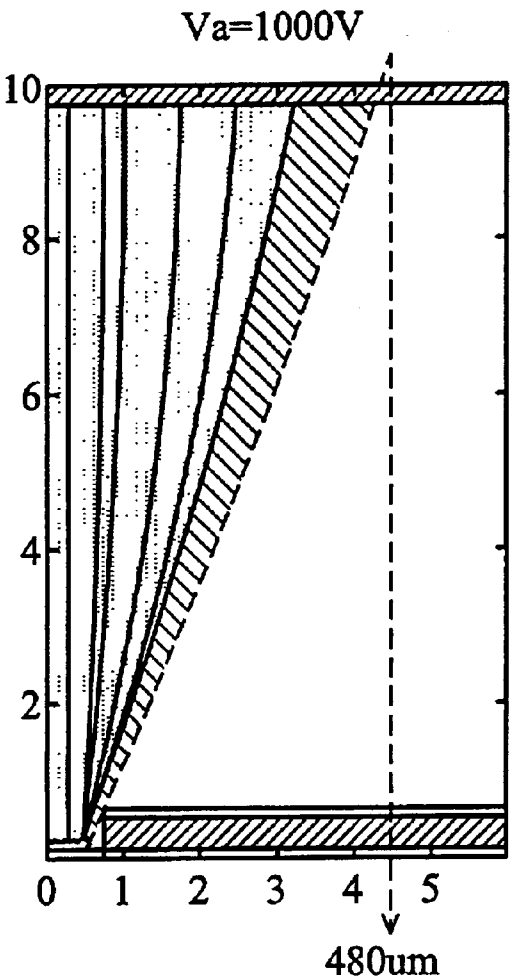
FIG. 4a (PRIOR ART)
FIG. 4*a* is a diagram of an electron beam emitted by the prior driving method.
Figure 5A:
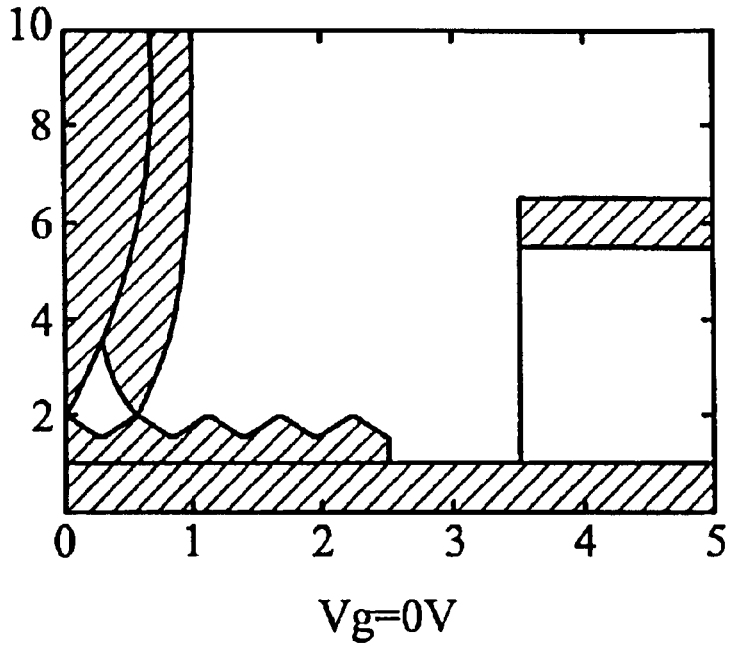
FIGS. 5*a*–5*c* are diagrams of the driving simulation with different gate voltages according to the invention.
Figure 5B:
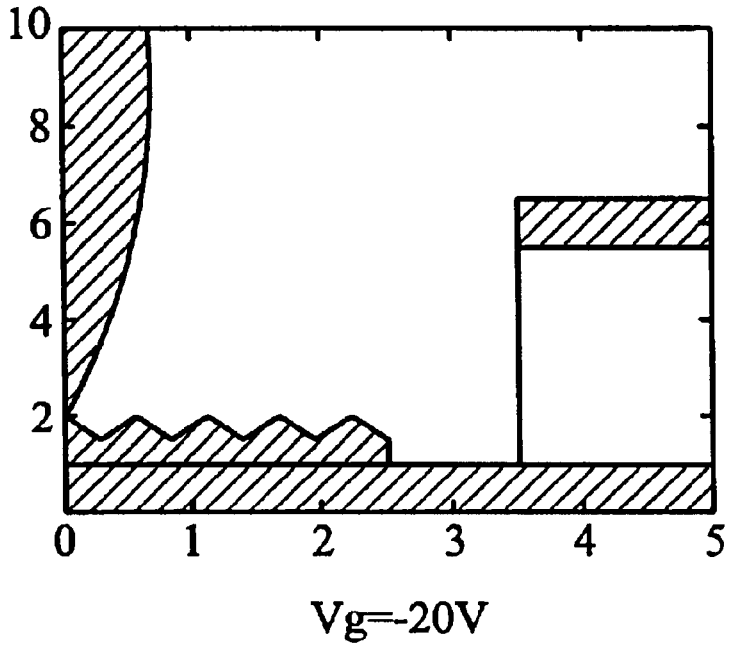
Figure 5C:
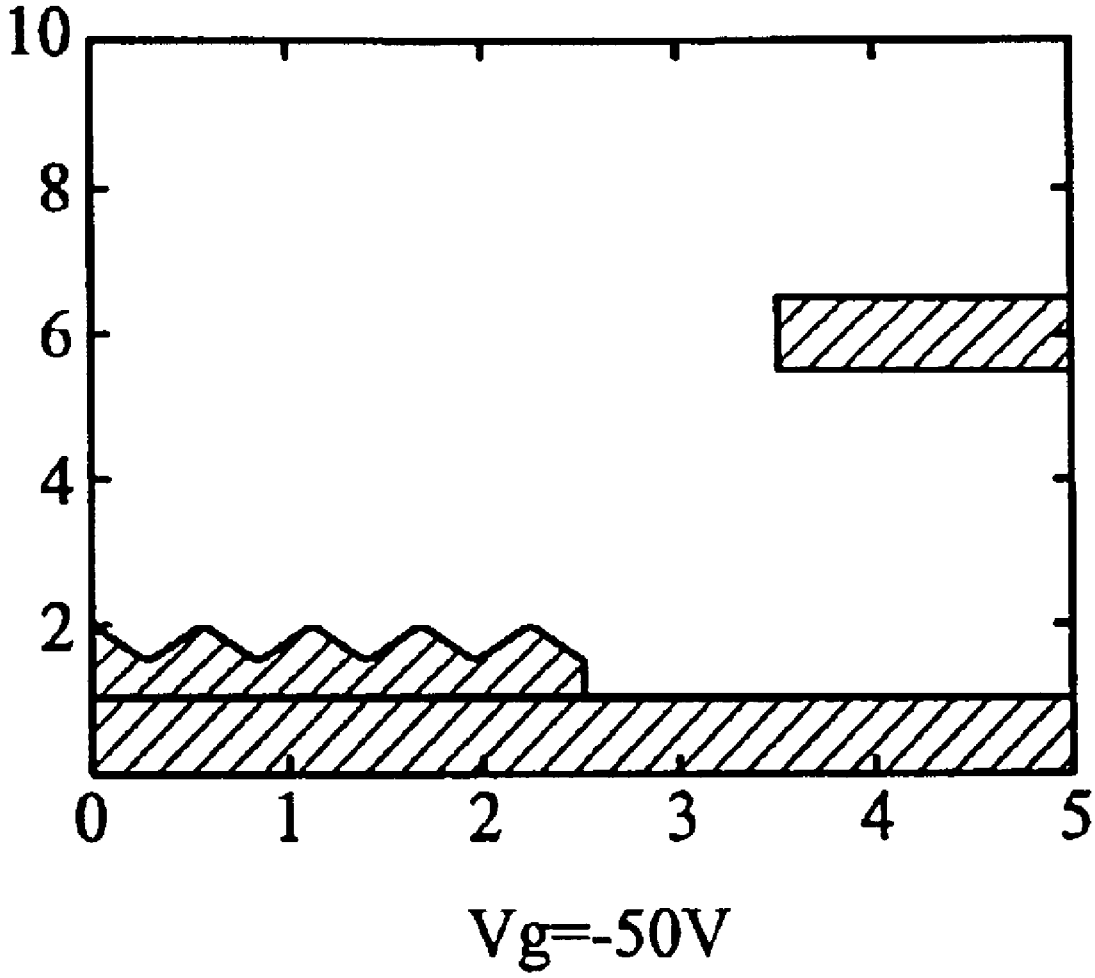

A prior and inventive driving comparison is shown in the following. In an example of the triode FED structure as shown in FIG. 2, the prior driving conditions are: using the low work function electronic emitters, taking the spacer height about 1 mm, applying about +1000V to the anode (i.e., Va=1000V), grounding the cathode (i.e., Vc=0V) where the low work function electronic emitters are located, and evaluating and applying the requirement voltage Vg≈200V (multiplying the distance from the cathode to the anode by 3–5V/um) to the gate. With the result shown in FIG. 4*a*, the emitted electron beam's diameter is about 960 um by simulation and practical measurement. When Vg is reduced from 200V to 0V, the electron emission is turned off. On the other hand, the driving conditions according to the invention are: Va=3000V, Vg=Vc=0V. As such, as shown in FIG. 4*b*, the electron beam by simulation is about 50 um, much smaller than in the prior art, when the anode pulls the electron beams out of the electronic emitters of the cathode. This presents good verticality (high resolution). When different negative voltages are applied to the gate, as shown in FIGS. 5*a*–5*c* with Vg=0, −20 and −50, the action of the electronic emitter is changed from "normal emission" to "turned off". Additionally, if the cathode is floated, the electron beam emission can also be turned off. As cited above, the present driving method can have high power electron beam, for example, 3000V, and a high lighting efficiency at the same time. The present driving method is a "normal ON" device, other than the prior driving method is a "normal OFF" device. A normal ON device means that the emission action is turned off only when a certain negative voltage is applied to the gate, while a normal OFF device means that the emission action is turned on only when a certain positive voltage is applied to the gate.

Figure 6:
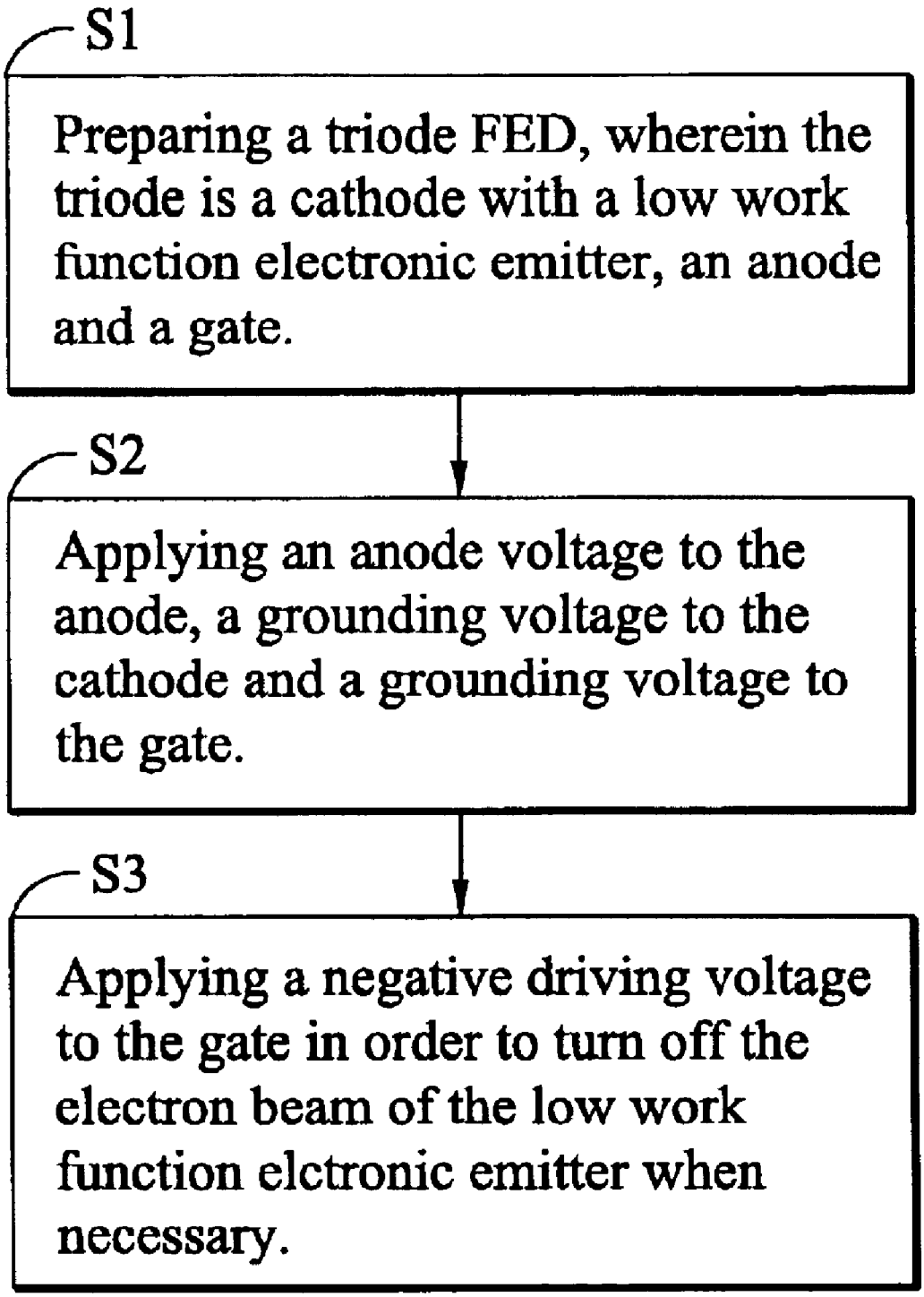
FIG. 6 is a flowchart of the driving method according to the invention.

As shown in FIG. 6, the present driving method first prepares a triode FED (S1), wherein the triode is a cathode with a low work function electronic emitter to emit an electron beam, an anode to pull the electron beam out of the cathode, and a gate to gate the electronic emitter. Then, an anode voltage is applied to the anode, a grounding voltage to the cathode and to the gate (S2). At this time, the electronic emitter continuously emits the electron beam. When necessary, a negative driving voltage is applied to the gate to turn off the electron beam (S3). The low work function electronic emitter can be a CNT, a GNF, a porous silicon material, etc.

Although the present invention has been described in its preferred embodiment, it is not intended to limit the invention to the precise embodiment disclosed herein. Those who are skilled in this technology can still make various alterations and modifications without departing from the scope and spirit of this invention. Therefore, the scope of the present invention shall be defined and protected by the following claims and their equivalents.

What is claimed is:

1. An improved FED driving method, comprising the following steps:

preparing a triode FED, wherein the triode is a cathode with a an electronic emitter to emit an electron beam, an anode to pull the electron beam out of the cathode, and a gate to gate the electronic emitter;

applying an anode voltage to the anode, a turn-on voltage to the cathode and a first driving voltage to the gate; and applying a second driving voltage to the gate to turn off the electron beam, wherein the second driving voltage is a negative voltage less than 0V.

2. The improved FED driving method of claim 1, further comprising a step of floating the cathode when necessary to turn off the electron beam.

3. The improved FED driving method of claim 1, wherein the preparing a triode FED uses any prior thick film technique.

4. The improved FED driving method of claim 1, wherein the anode voltage is in a range of 50 to 30,000 volts.

5. The improved FED driving method of claim 1, wherein the turn-on voltage is a grounding voltage.

6. The improved FED driving method of claim 1, wherein the first driving voltage is a grounding voltage.

7. The improved FED driving method of claim 1, wherein the negative voltage is greater than or equal to −800 volts.

8. The improved FED driving method of claim 1, wherein the electronic emitter is formed by a Carbon Nano Tube (CNT).

9. The improved FED driving method of claim 1, wherein the electronic emitter is formed by a Graphic Nano Fiber (GNF).

10. The improved FED driving method of claim 1, wherein the electronic emitter is formed by a porous silicon material.

11. The improved FED driving method of claim 1, wherein the electronic emitter is any low work function electronic emitter formed by one selected from the group consisting of thin film technique and nanotechnology.

* * * * *